United States Patent [19]

Liese

[11] Patent Number: 5,013,001

[45] Date of Patent: May 7, 1991

[54] RECEPTACLE

[75] Inventor: Gerhard Liese, Zierenberg-Oberelsungen, Fed. Rep. of Germany

[73] Assignee: Hewi Heinrich Wilke GmbH, Arolsen, Fed. Rep. of Germany

[21] Appl. No.: 263,178

[22] Filed: Oct. 27, 1988

[30] Foreign Application Priority Data

Oct. 30, 1987 [DE] Fed. Rep. of Germany ..... 3736737

[51] Int. Cl.[5] ..... A47K 5/00

[52] U.S. Cl. ..... 248/551; 248/221.3; 403/325; 403/328

[58] Field of Search ..... 248/221.3, 551–553; 403/325, 328, 327, 407.1; 292/59

[56] References Cited

U.S. PATENT DOCUMENTS

| | | | |
|---|---|---|---|
| 3,097,859 | 7/1963 | Sindelar | 403/327 X |
| 3,337,245 | 8/1967 | Prange | 403/327 |
| 4,385,851 | 5/1983 | Bellamy | 292/59 X |
| 4,568,217 | 2/1986 | Forsman et al. | 403/327 X |

FOREIGN PATENT DOCUMENTS

| | | | |
|---|---|---|---|
| 255070 | 6/1967 | Austria | 248/221.3 |
| 58062 | 8/1891 | Fed. Rep. of Germany | 248/551 |
| 3105185 | 9/1982 | Fed. Rep. of Germany . | |
| 716004 | 6/1953 | United Kingdom | 248/551 |
| 1223738 | 3/1971 | United Kingdom | 248/221.3 |

*Primary Examiner*—Alvin C. Chin-Shue
*Attorney, Agent, or Firm*—Michael J. Striker

[57] ABSTRACT

The invention relates to a receptacle having a base part, a cover part which can be drawn over the base part and a resiliently mounted catch for joining the two parts together. A means for safeguarding against unauthorized removal of the cover part from the base part provides the catch with a crown in a cavity in the base part and associates with the crown a locking mechanism which is also disposed in the cavity and can be actuated from without only by a tool.

13 Claims, 5 Drawing Sheets

RECEPTACLE

BACKGROUND OF THE INVENTION

The invention relates to a receptacle with at least one base part which can be fastened to a wall or the like, a cover part which can be drawn onto said base part and can completely cover the latter in the installed state, and a catch resiliently mounted on one of the said parts which in order to fasten the base part to the cover part catches, in its installed state, in the other part and thereby prevents unintentional removal of the cover part from the base part.

Receptacles of this kind are known (DE-OS 25 35 894) and are used in many ways, for example as soap dishes, mouth rinse cup receptacles, ashtrays, multi-purpose receptacles, or the like, especially in household and sanitary applications. Depending on their purpose, these receptacles are provided with catches in the form of simple pushbuttons which can be pressed out of the catching position whenever the cover part is to be withdrawn from the base part. When the receptacles are exposed to the public, however, a theft-proof lock is often associated with the resiliently mounted catch in order to largely prevent any unauthorized removal of the cover part from the base part. In such a theft-proof lock, for example, the resiliently mounted catch can be disengaged only in a very specific position in which it first must be placed, and/or preferably only through a small opening formed in the cover part. To remove the cover part, therefore, either a precise knowledge of the theft-proof lock and/or a special tool are necessary.

One considerable disadvantage of such receptacles is that the catches are formed on resilient tabs provided on the base part or they consist of such tabs. Since the base parts as a rule are made in one piece from plastic by injection molding and the tabs are thin and consequently elastic strips of material, the base parts necessarily have a very irregular surface, i.e., one provided with openings, recesses, slits or the like. Therefore they are hard to clean unless they are removed from the wall or the like, and this is intolerable for hygienic reasons, especially when the receptacles are used in hospitals or the like.

Lastly, DE-OS 25 35 894 teaches to provide as catches in such receptacles thin pins driven into aligned bores in the base and cover parts and to associate them with locking elements formed on the base part in the form of resilient tabs, such that the pins cannot be pushed through small bores provided in the cover part into a cavity within the receptacle to release the catch until the tabs are pushed away. Such a design, however, not only does not eliminate the above-mentioned hygienic problems, but also it is undesirable for formal and other reasons, for example because when the receptacle is installed the locked position is always established, although this is not at all necessary in residential applications and often is not wanted, either.

The purpose of the invention is therefore to provide the receptacle of the kind described above with another kind of theft-proof lock which also permits the production of base parts with a smooth, regular surface.

SUMMARY OF THE INVENTION

This purpose is accomplished in accordance with the invention in that the catch has a crown projecting into a cavity in the base part and a locking mechanism which is likewise disposed in the cavity and can be operated from the exterior by means of a tool by which it can be set either in an unlocked position or in a locked position, and which in the unlocked position permits the catch to be released, but in the locked position prevents it.

The invention offers the advantage that the base part can be provided with a smooth, easily cleaned surface, from which only the catch cooperating with the cover part projects, because all other parts of the catch and of the locking mechanism can be contained in the cavity and the cavity can be sealed hermetically from the outside. Furthermore, when the receptacle is installed the locking mechanism is accessible only with a tool, so that unauthorized persons cannot easily change it to the unlocked state. Lastly, it is advantageous that the unlocked and locked positions can be set optionally, so that, without modification, the receptacle can be left permanently unlocked, at least in residential applications.

Additional advantageous features of the invention will be found in the subordinate claims.

BRIEF DESCRIPTION OF THE DRAWINGS

The invention will be further explained below with the aid of an embodiment in conjunction with the appended drawings, wherein.

Description of a Preferred Embodiment

Figure 1:
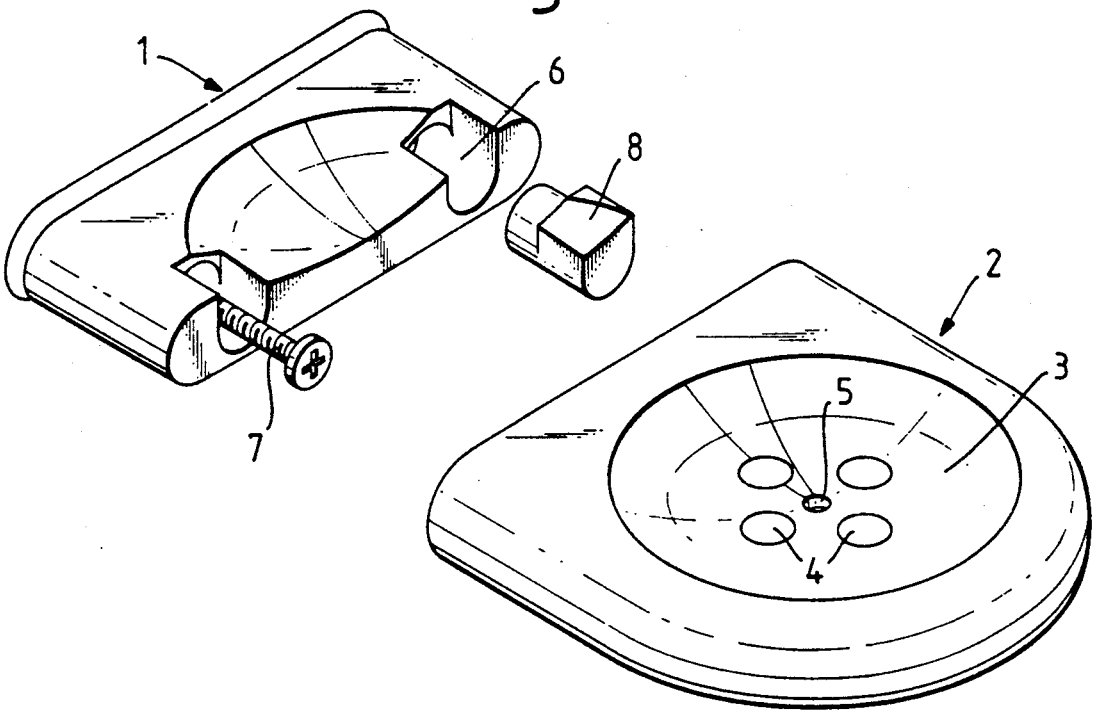
FIG. 1 is a perspective, exploded drawing of a receptacle in accordance with the invention, consisting of a cover part and a base part.

FIG. 1 shows schematically a receptacle in accordance with the invention in the form of a soap dish. It consists of a base part 1 and a cover part 2 which can be drawn as a whole onto the base part. On its upper side the cover part 2 has, for example, a dished portion 3 and, if desired, bosses 4 on which to lay a cake of soap. In the center of the dished portion 3 a drain opening 5 is provided. The base part 1 consists of a massive body having two screw holes 6 for mounting screws 7. The portions of the screw holes 6 that remain open after the mounting screws 7 have been driven are filled with plugs 8 which set flush with the rest of the surface of the base part 1, so that the surface is smooth on all sides and therefore can easily be cleaned.

Figure 2:
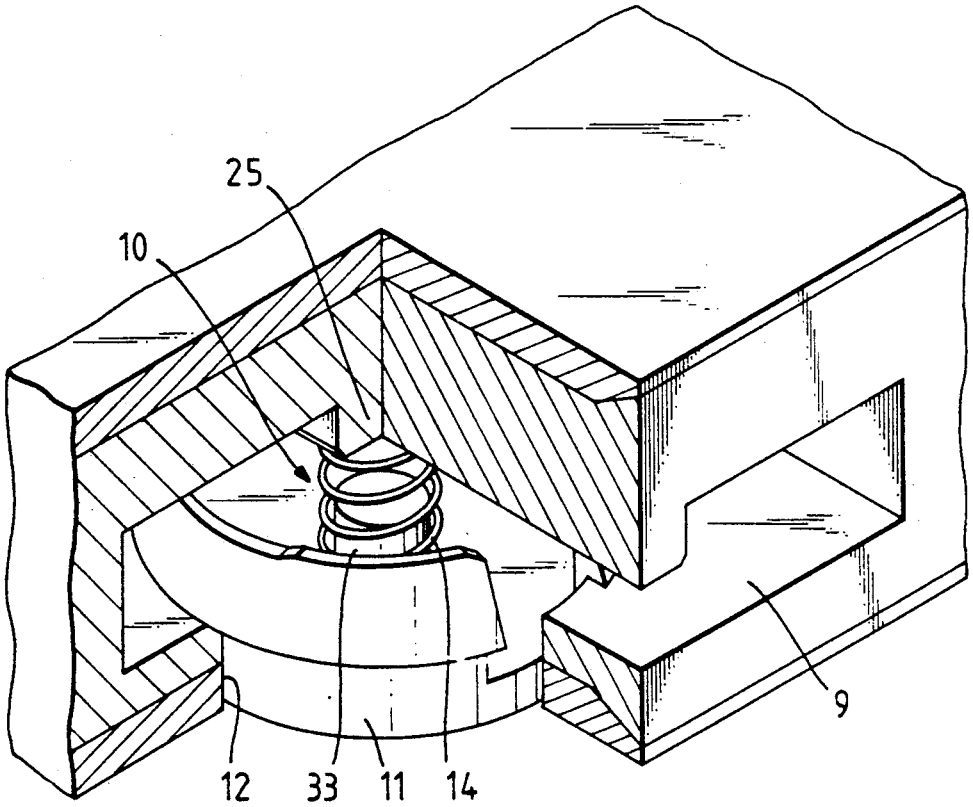
FIG. 2 is a perspective and partially cut-away detail of the receptacle of FIG. 1 showing the locking mechanism.

In FIG. 2, the base part 1 has a cavity 9 in which a locking mechanism 10 is disposed. On the bottom a catch 11 is contained in the base part 1, which, when the cover part 2 is installed, catches in an opening 12 provided in its bottom and thus prevents any unintentional removal of the cover part 2 from the base part 1. If it is desired to remove the cover part, the catch 11 is pushed deeper into the base part 1 and its cavity 9 with a finger or the like, against the force of a spring 14, until it emerges from the opening 12 and releases the cover part 2. This is possible, of course, only when the locking mechanism 10 is in an unlocked position.

Details of the receptacle in accordance with the invention will be seen in FIGS. 3 to 20.

Figure 3:
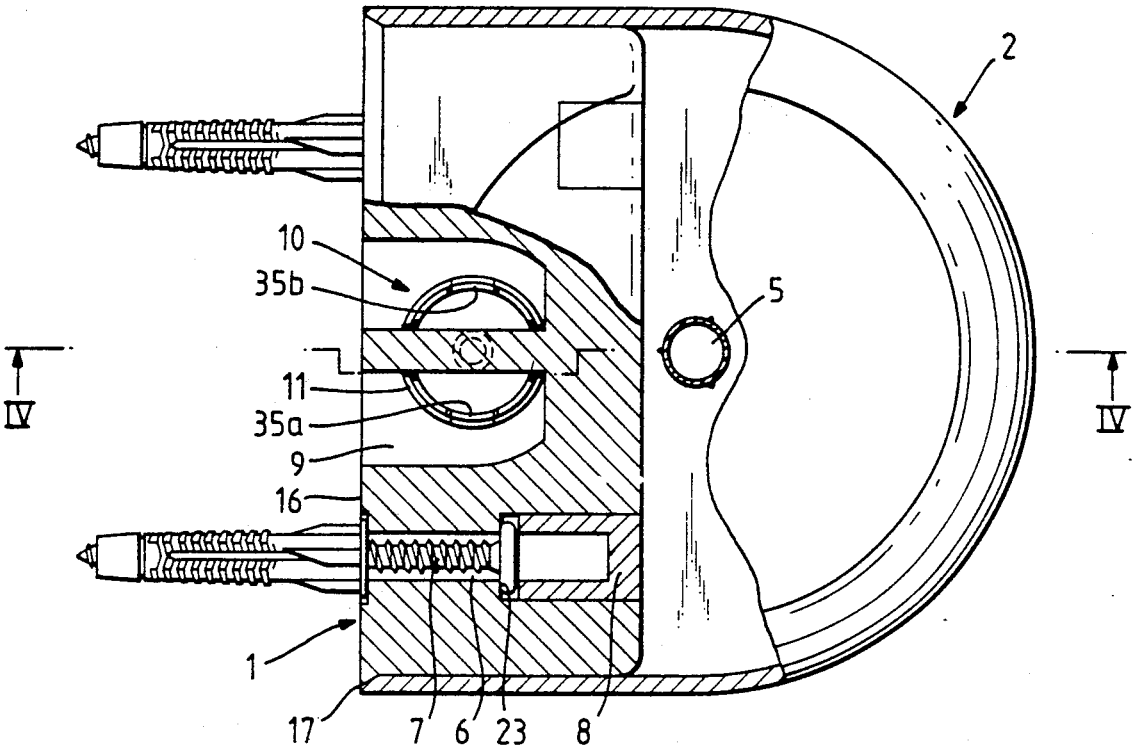
FIG. 3 is a cut-away plan view of the receptacle.
Figure 4:
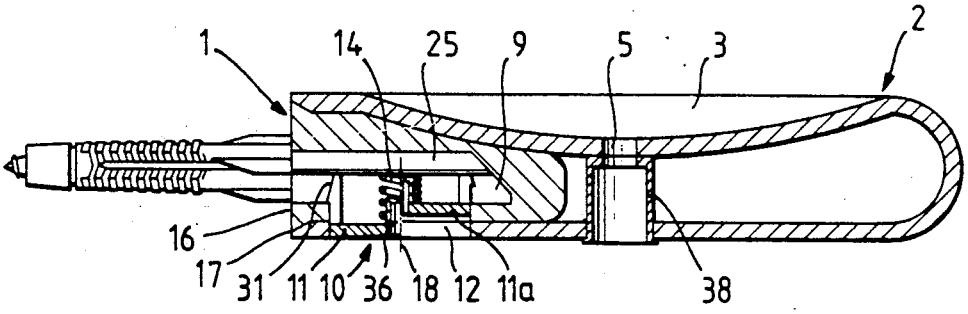
FIG. 4 is a section along line IV—IV of FIG. 3.
Figure 5:
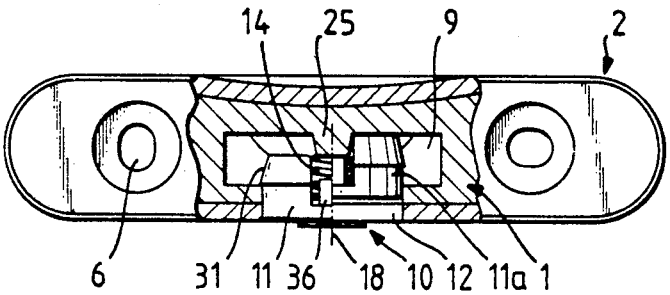
FIG. 5 is a partially cut-away rear view of the receptacle.
Figure 6:
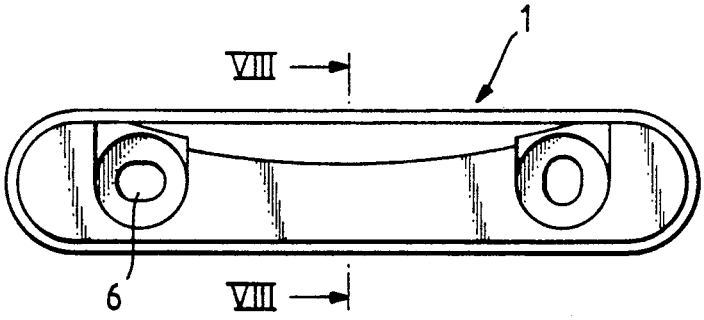
FIG. 6 is a front elevation of the base part.
Figure 7:
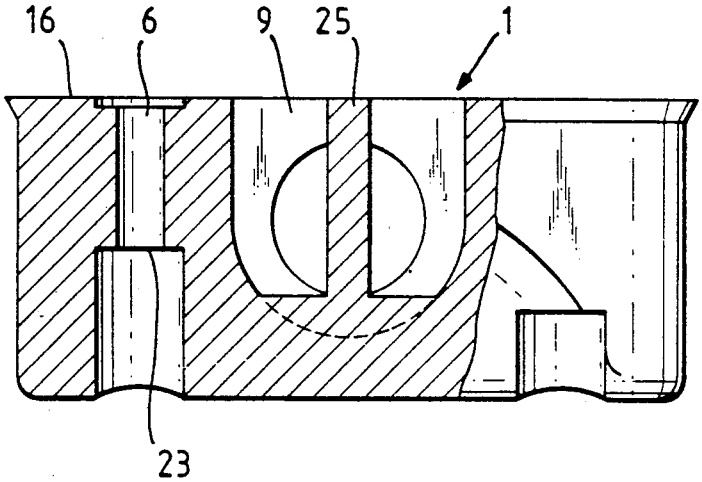
FIG. 7 is a cut-away top plan view of the base part
Figure 8:
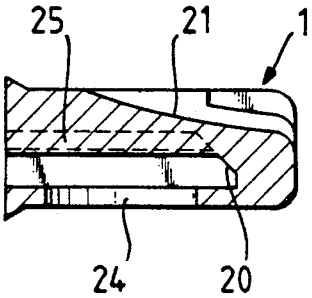
FIG. 8 is a section taken along line VIII—VIII of FIG. 6.
Figure 9:
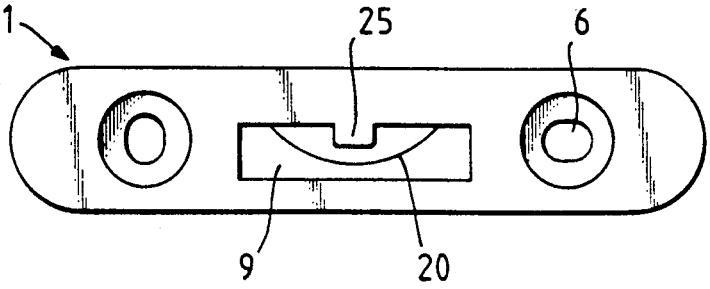
FIG. 9 a rear view of the base part.

In the installed state shown in FIGS. 3 to 5, the base part 1 lies with its flat rear side 16 flatly against a wall or the like, and a gasket or the like can also be disposed between the two. The cap-like cover part 2 is pressed onto the base part 1, covers the latter completely, and likewise abuts with its rear, annular edge 17 against the wall or gasket or the like. In FIGS. 4 and 5 the catch 11 is normally urged by the spring 14 into the opening 12, which best has a cross section precisely matching the cross section of the catch 11. This position is represented in FIGS. 4 and 5, on the left side, in each case, of an axis 18 of the catch 11. To the right of the axis 18 is shown the state in which the catch 11 is urged against the force of spring 14 into cavity 9 when the locking mechanism 10 is in the unlocked position. The locking means 11 is in this case disengaged from the opening 12 so that the cover part 2 can be removed from the base part 1.

In FIGS. 6 to 9 the cavity 9 is in a central portion of the base part 1 and is open only towards its otherwise planar back 16 at which the screw holes 6 also surface. The cavity 9 has a substantially rectangular cross section and is defined in a front section by a slightly inwardly curved wall 20 (FIGS. 8 and 9) because at that point a curvature 21 precisely matched to the curvature of the dished portion 3 of the cover part 2 is provided in its upper side in order to provide the cover part with firm support. The substantially cylindrical screw holes 6 are counterbored so as to provide a shoulder 23 for the heads of the mounting screws 7 (FIG. 3). The portions of the sections of the screw holes 6 which are of larger diameter and remain free after the mounting screws have been fully driven serve to accommodate the plugs 8.

In the portion of the base part that forms the floor of cavity 9 is an opening 24 to accommodate the catch 11. The portion of the base part 1 situated opposite the opening 24 is provided with a blocking bolster 25 in the form of a bar-like projection extending transversely across the opening 24, running parallel to the screw holes 6 and made preferably in one piece with the base part 1.

Figure 10:
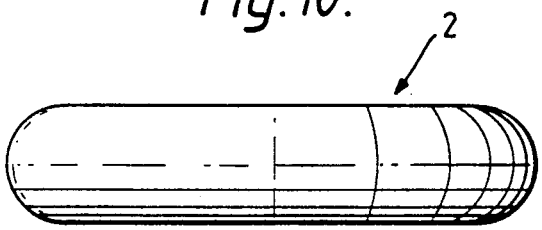
FIGS. 10 and 11 are a front elevation and plan view of the cover part.
Figure 11:
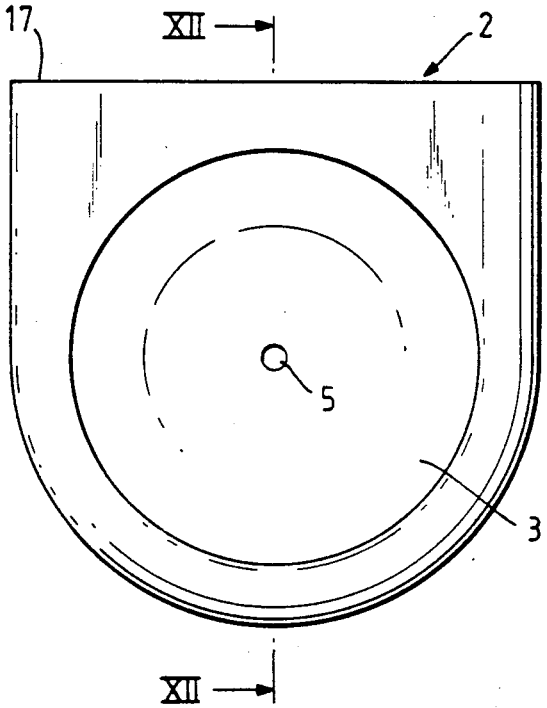
Figure 12:
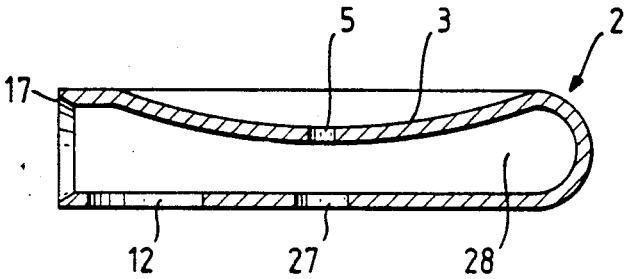
FIG. 12 is a section along line XII—XII of FIG. 11.
Figure 13:
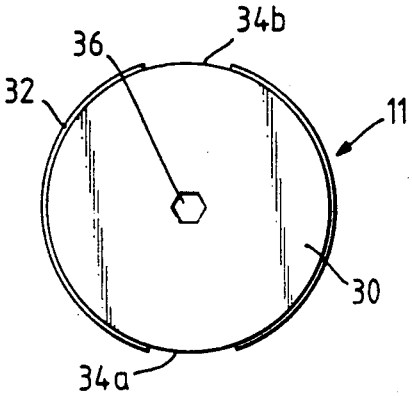
FIGS. 13 to 16 are bottom, front and side views as well as a top view of a catch of the receptacle of FIGS. 2 to 5.
Figure 14:
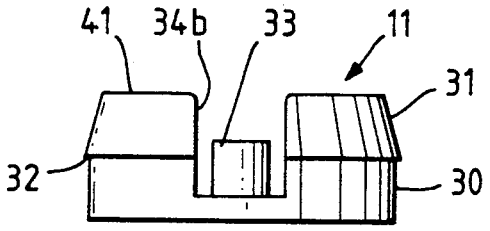
Figure 15:
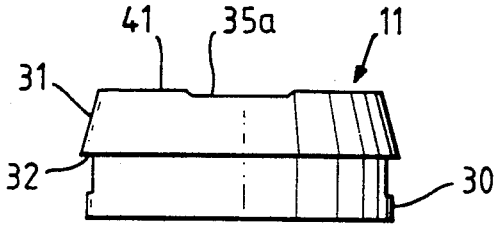
Figure 16:
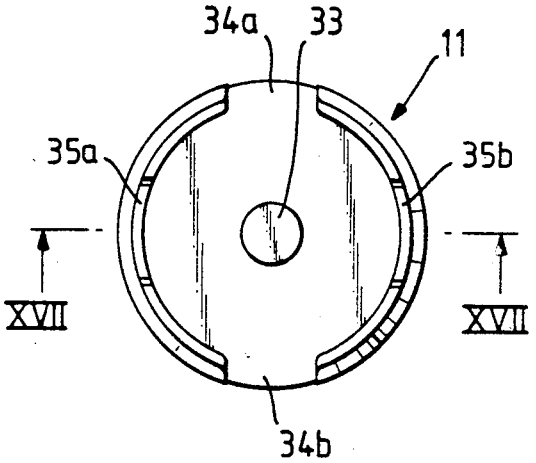
Figure 17:
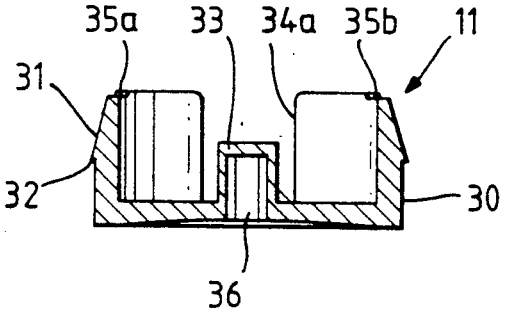
FIG. 17 is a section along line XVII—XVII of FIG. 16.

In FIGS. 10 to 12 the cover part 2 is cap-like and provided with a smooth surface all around. It has a second drain opening 27 situated underneath the drain opening 5, and, like the opening 12, is formed in its bottom. The cover part 2 defines a cavity 28 which is open only at the back and has in its rearward section an internal shape which corresponds substantially to the external shape of the base part 1 so that, although the cover part 2 can be placed on the base part 1 with an easy sliding fit, it will otherwise be held tight and wobble-free on the base part.

In FIGS. 13 to 17 the catch 11 is of cylindrical configuration in its bottom section 30, its diameter corresponding precisely to the diameter of opening 12 in cover part 2 and opening 24 in base part 1. The cylindrical section 30 is provided with a crown 31 which will be situated entirely in the cavity 9 and is of a ring-like configuration. The crown 31 has at its transition to section 30 a preferably annular undercut 32 projecting beyond its cross section, and has an outside diameter tapering conically towards its free end to form an insertion ramp.

In the center of the bottom of the crown 31 or also on the bottom of a recess extending all the way into section 30, there is a post 33 on which the one end of a spring 14, which is a compression coil spring (FIGS. 2, 4, 5), is placed.

The crown 31 has at diametrically opposite locations two deep notches **34*a* and 34*b* having a width corresponding at least to the width of the blocking bolster 25 and can be prolonged on the one side into the section 30 and on the other side all the way to the upper edge 41 of crown 31. At two additional diametrically opposite locations the crown 31 has two shallow U-shaped notches 35*a*, 35*b*, which also have a width corresponding at least to the width of the blocking bolster 25, but have a substantially lesser depth than the notches 34*a* and 34*b*. The notches 34*a* and 34*b* and notches 35*a* and 35*b* are preferably distributed at 90 degrees apart from each other on the circumference of the crown 31**.

The catch 11 has on its bottom, in FIGS. 4, 5, 13 and 17, a tool socket 36 which consists preferably of a polygonal hole, and can also be a blind hole, and serves for the insertion of an Allen wrench.

Figure 18:
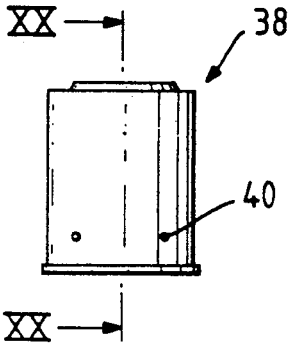
FIGS. 18 and 19 are enlarged front and top views of a drain tube of the receptacle of FIGS. 1 to 5.
Figure 19:
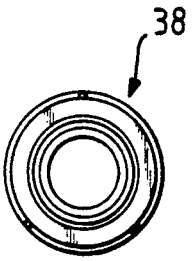
Figure 20:
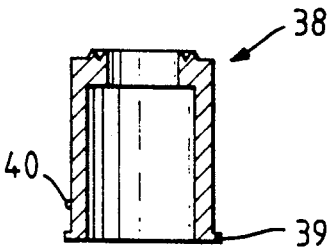
FIG. 20 is a section along line XX—XX of FIG. 18.

FIGS. 18 to 20 show a small drain tube 38 with a cross section corresponding to the cross section of the drain opening 27 in cover part 2 (FIG. 12) and a small bead 39 at the bottom end. The drain tube 38 is inserted from the bottom into the drain opening 27 until bosses 40 formed on its circumference snap behind the edge of the drain opening 27 (FIG. 4) and its bead 39 is tightly in contact with the bottom of the cover part 2 at one end, and a surface at the opposite end of the drain tube 38 abuts internally against the upper side of the cover part 2. Additionally, the drain tube 38 can be cemented to the cover part 2 or be bonded thereto by ultrasonic welding if both parts consist of a weldable plastic. Thus, in spite the fact that drainage is provided, the cavity between the base part 1 and the cover part 2 will be sealed hermetically against liquids that collect in the bowl 3 of the dish and then can flow down through the drain tube 38, which is extremely important for hygienic reasons.

To assemble the receptacle described, the crown of the catch 11, with the spring 14 in place, is pressed through the opening 24 into the cavity 9 of the base part 1, until the undercut 32 in accordance with FIGS. 4 and 5 snaps behind the inside margin of the opening 24. This procedure is facilitated by the fact that the sections of crown 31 remaining beside the notches **34*a* and 34*b* can flex resiliently inwardly. The catch 11 is then unreleasably fastened in the base part 1, but is both rotatable and displaceable parallel to its axis 18 (FIGS. 4 and 5) in the opening 24. At the same time it is under the force of the spring 14 whose other end thrusts against the blocking bolster 25 and urges the undercut 32 against the wall section defining the bottom of the cavity 9. Furthermore, the arrangement is such that the cylindrical section 30 in this state projects out of the opening 24 to a degree that corresponds to the wall thickness at the bottom of the cover part 2**.

After the base part 1 has been fastened to a wall or the like the plugs 8 are inserted. Then the cover part 2 is installed until its end 17 abuts against the wall or the like. In this position its opening 12 is precisely under section 30 of catch 11 so that the latter can snap into it. On account of the resilient properties, if the cover part is made of plastic it is substantially immaterial whether or not the catch 11 projects beyond the bottom of the cover part 1 on the base part 1. The axial height of the crown 31 is so chosen that, when the undercut 32 of the catch 11 contacts the margin of the opening 24 in the base part 3, three states can be created, depending on the rotational position of the catch 11.

If the catch 11 is in the rotational position represented in FIGS. 4 and 5 on the left side of the axis 18, which corresponds to an unlocked position, the blocking bolster 25 is precisely opposite the opening formed by the notches 34*a* and 34*b* and the free space between them. It is therefore possible to force the catch against the force of spring 14 at least deep enough into the cavity 9 that section 30 is completely removed from the opening 12 and disappears in opening 24 (cf. in FIGS. 4 and 5 on the right side, in each case, of the axis 18). This movement is limited by the abutment of the free edge 41 (FIGS. 14 and 15) of the crown against the upper wall defining the cavity 9, for the purpose of preventing section 30 from being forced entirely out of the opening 24. When the catch 11 is released, the spring 14 automatically returns to the position represented in FIGS. 4 and 5 on the left of the axis 18. The same applies accordingly to a second, unlocked position which can be reached by turning the catch 11 by 180°.

In private applications, the catch 11 can be left in either of these unlocked positions, so that the cover part 2 can be separated from the base part 1 simply by pressing the catch 11.

When the receptacle is used in public places, however, it is desirable to rotate the catch with a tool inserted into the socket 36 by 90° in the one or the other direction until the blocking bolster 25 engages in the notches 35*a* or 35*b* (FIGS. 15 and 16) of the crown 31. In this state, which corresponds to the two selected locking positions, the catch 11 can be pressed in only to such a slight extent that its section 30 still projects sufficiently far beyond the bottom of the base part 1 because the blocking bolster 25 blocks any further displacement. The cover part 2 can then no longer be released without knowledge of the established safeguard against theft or the like.

In the rotational positions which can be reached between these four selected rotational positions of the catch 11, which are also locked positions, the edge 41 of the crown 31 abuts against the blocking element 25. In these rotational positions the fastening element 11 has a firm seat, but if it is made of plastic it yields slightly resiliently in the area of its edge 41 and the undercut 32, and therefore it is rotatable also in this state. This configuration has two advantages. On the one hand the blocking bolster 25, after running over the upper edge 41 of of the crown 31, can be felt snapping into the notches 34*a* and 34*b* and notches 35*a* and 35*b*, so that the user can perceive that the desired rotational position has been reached. On the other hand, it is virtually impossible for an unauthorized person without a corresponding tool to turn the catch 11 away from a locked position to an unlocked position because the friction resistance between the locked and unlocked positions is very great. This is true especially when, with the cover part 2 installed, section 30 of the catch 11 is flush with its bottom. In this case, the attempt could be made to rotate the catch 11 by pressing tightly with a finger against section 30. This, however, would still further increase the friction resistance between the edge 41 and the blocking element 25 and thereby make it still more difficult to shift the blocking bolster 25 out of the notches 35*a* and 35*b* onto the edge 41 of the crown. 31. If a tool introduced into the socket 36 is used, however, a purely rotational movement can be exercised, in which no increased friction is produced. Unauthorized removal of the cover part 2 from the base part 1 is therefore virtually impossible. If an unauthorized person is in possession of the necessary tool but has no knowledge of the opening mechanism, it is only by chance that he could find an unlocked position.

The invention is not limited to the embodiment described, which can be modified in many ways. This is especially true of the locking mechanism 10 which in the embodiment described consists essentially of the fixedly disposed blocking bolster 25 and the crown 31 which is rotatable and displaceable together with the catch 11 and which bears the notches 34*a*, 34*b*, 35*a* and 35*b*. It would be possible, for example, to make the catch 11 nonrotatable and instead to make the blocking bolster 25 rotatable or displaceable on the base part 1. In this case the socket 36 could run all the way through the post 33 and confront a matching socket in the blocking bolster 25. It would furthermore be possible to create a special working opening in the bottom of the cover part 2. Other kinds of locking mechanisms are also conceivable. Furthermore, the invention is not limited to receptacles in the form of soap dishes, since the cover part 2 only needs to be adapted to the purpose desired in the particular case. In the case of receptacles of comparatively large dimensions, such as those often used behind bathroom mirrors, two or more comparatively small base parts can be provided instead of a single, correspondingly large base part, and at least one of them can be provided with a locking mechanism as described above.

The base part and cover part can be made preferably by injection molding from plastic. The same applies to the plugs 8, catch 11 and drain tubes 38.

I claim:

1. A receptacle, comprising: at least one base part adapted to be fastened to a wall or the like and having a first opening; said base part having a cavity which is connected with said first opening; a cover part adapted to be mounted on said base part, covering the latter in an installed state and having a second opening; a catch resiliently mounted on said base part; said catch having a crown projecting into said cavity, said crown having an undercut, and a spring pressing said undercut against an edge of the first opening; said catch projecting from said first opening to the outside of the base part, and catching, in the installed state, in the second opening, thereby coupling both parts to each other, but being releasable from said second opening by being forced deeper in to the first opening from the exterior for separating the cover part from the base part; and a locking mechanism having rotatable means which is rotatably mounted in said base part and is rotatable from the exterior either in at lest one unlocked position or in at least one locked position, and having blocking means which cooperate with said rotatable means and which in the locked position prevents the catch from being released from said second opening and which in the unlocked position permits the catch to be released from the second opening.

2. A receptacle according to claim 1, wherein said blocking means is a projection projecting into said cavity.

3. A receptacle according to claim 2, wherein said rotatable means is said catch.

4. A receptacle according to claim 1, wherein the base part has a cavity connected with the first opening, wherein the blocking means has a projection projecting into the cavity, and wherein said rotatable means is said catch, the catch having a recess able to receive the projection and being rotatably mounted on said base part such that the same can be rotated at least into a first position in which said projection confronts the recess, and into at least a second position in which the projection confronts an edge surrounding an edge of said catch defining a gap.

5. A receptacle according to claim 3, wherein said blocking means consists of an elongated ridge.

6. A receptacle according to claim 4, wherein said catch has a crown being accommodated in said cavity, said crown being ringlike in configuration and being provided with two diametrically opposite notches intended for the accommodation of the blocking means and forming said gap.

7. A receptacle according to claim 3, wherein said catch has on its underside a socket for a tool.

8. A receptacle according to claim 4, wherein said catch has on its underside to a socket for a tool.

9. A receptacle according to claim 3, wherein said catch has on an underside a blind hole intended for the introduction of an Allan wrench.

10. A receptacle according to claim 4, wherein said catch has on an underside a blind hole intended for the introduction of an Allan wrench.

11. A receptacle according to claim 1, wherein the base part consists of a massive body with smooth surfaces, only screw holes and and cavity for accommodation of parts of the locking mechanism being formed in said body in addition to said first opening.

12. A receptacle according to claim 11, wherein wall sections of the base part adjoining the screw holes are provided with shoulders for the accommodation of screw heads, and plugs are provided for plugging the sections of the screw holes which remain open.

13. A receptacle according to claim 1, wherein the cover part has on an upper side and in an area extending over the base part in the installed state a dished receptacle with a drain opening which is connected by a drain tube to a drain opening on a bottom of the cover part.

* * * * *